United States Patent [19]

Looney

[11] 3,933,423

[45] Jan. 20, 1976

[54] AZOIC DYEING OF LEATHER

[75] Inventor: Catharine Elizabeth Looney, Wilmington, Del.

[73] Assignee: E. I. Du Pont de Nemours and Company, Wilmington, Del.

[22] Filed: May 15, 1973

[21] Appl. No.: 360,584

[52] U.S. Cl. ..... 8/13; 8/12; 8/12.5; 96/13; 96/91 R; 428/151; 428/473

[51] Int. Cl.[2].... D06P 3/12; D06P 3/32; D06P 5/00; G03C 1/52

[58] Field of Search..... 8/13, 12, 12.5, 10; 96/13, 96/91 R; 117/15, 142; 428/151, 473

[56] References Cited

UNITED STATES PATENTS

| | | | |
|---|---|---|---|
| 641,394 | 1/1900 | Kauschke | 8/13 |
| 2,405,165 | 8/1946 | Pepper | 8/13 |
| 2,541,178 | 2/1951 | Slifkin | 96/13 |
| 2,616,803 | 11/1952 | Ravich | 96/91 R |
| 2,913,301 | 11/1959 | Streck | 8/13 |
| 2,967,751 | 1/1961 | Streck | 8/13 |
| 3,409,384 | 11/1968 | Streck | 8/13 |
| 3,414,366 | 12/1968 | Nordstrom et al. | 8/12 |
| 3,472,605 | 10/1969 | Wicki et al. | 8/12 |

FOREIGN PATENTS OR APPLICATIONS

| | | | |
|---|---|---|---|
| 2,109,313 | 9/1971 | Germany | 8/13 |
| 1,069,574 | 5/1967 | United Kingdom | 8/12 |
| 707,884 | 4/1954 | United Kingdom | 8/13 |

*Primary Examiner*—Leland A. Sebastian
*Assistant Examiner*—T. S. Gron

[57] ABSTRACT

Dry leather is dyed with azoic dyes without wetting the leather with water by incorporating into the leather the required diazonium component and any required coupling component in a substantially non-aqueous volatile low-viscosity solvent and incorporating into the leather any other materials required for the coupling reaction in such a solvent or as a vapor. The coupling component can be a natural or synthetic phenolic tanning agent employed in tanning the leather. Dye patterns can be applied to the surface of the leather by using a light-sensitive diazonium component and photo-imaging the surface before effecting coupling. Dry leather is dyed by such processes without significant change in properties.

17 Claims, No Drawings

AZOIC DYEING OF LEATHER

BACKGROUND OF THE INVENTION

1. Field of the Invention

This invention pertains to the dyeing of leather with azoic dyes and more particularly is directed to the azoic dyeing of dry or "crusted" leather, especially leather having a buffed suede surface, without wetting the leather with water.

2. Prior Art

The makers of leather goods face increasing need for leather of various colors and surface decoration effects in order to respond to rapid changes in the colors, textures, and decorative effects desired in high fashion clothing and accessories. They are also in need of economical processes to obtain such leather and to achieve uniform color and strength throughout. Processes by which dyes are chemically combined with leather and form uniformly within the structure and fibers of leather are most desired as they reduce frictional transfer of dye to other materials and changes in the color of leather upon abrasion. An acceptable process for dyeing and patterning dry leather should not make significant change in the esthetic or physical surface or bulk properties of the leather, such as results from the water-wetting of leather. Such processes are especially needed for dyeing and patterning dry napped suede leather for use in shoe tops, jackets, and other similar applications. Inexpensive patterning processes are also needed for preparing leather for use in handicraft kits.

The available art processes for dyeing dry leathers do not fill these needs. For dyeing such leathers in depth, it is the usual practice to rewet the leather with water containing additives which assist in removing oils and greases which would prevent even penetration of the dye, to adjust the acidity of the leather for optimum dye absorption and fixation, to introduce the dye into the leather, to adjust conditions to increase the efficiency of dye utilization, to rinse for removal of unabsorbed dye, to introduce fat liquor for desired flexibility and other physical properties, to redry the leather, to correct the effect of these processes on the surface and bulk esthetic and physical properties, and to continue with the conventional surface treatments which provide properties appropriate for the intended use. The dyes used have sometimes been azoic dyes formed in the presence of leather, (see U.S. Pat. No. 641,394, and Wilson, "Modern Practice in Leather Manufacture", Reinhold, New York (1941)), but usually have been preformed dyes of the acid, basic, direct, metallized, and mordant types, with dyes of different types frequently being used together or sequentially to obtain the desired degree of penetration and fullness of shade. Such operations are obviously complex, expensive, and difficult to control. Optical imaging of leather involving diazo dyes and aqueous solutions are disclosed in U.S. Pat. Nos. 1,472,323, 2,357,097 and 2,541,178.

Dry leathers have also been dyed by spraying or brushing with solutions of preformed dyes, for example in aqueous, alcoholic, or hydrocarbon solvents, (see "The Chemistry and Technology of Leather", Volume 3, Reinhold, New York (1956–1962)), but such processes usually result in incomplete and uneven penetration of the dyes.

The dyeing of buffed suede leathers has presented special problems because of the large amounts of dyes and time-consuming processes required to obtain complete and even penetration. In one process, for example, water-wet leather is impregnated with an aromatic amine with the assistance of an organic acid, the amine is diazotized with hydrochloric acid and sodium nitrite, the leather is thoroughly rinsed to remove unreacted sodium nitrite, the leather is impregnated with a material, such as toluene-diamine or a naphthol, which couples with the diazonium salt of the aromatic amine to form a dye within the leather, the leather is rinsed thoroughly under conditions which remove unreacted amines to avoid later darkening due to amine oxidation, and the leather is fat-liquored, dried, and finished in conventional fashion. In a similar process, the water-wet leather is impregnated with the coupling material under alkaline conditions, rinsed, acidified, impregnated with a diazonium component to produce an azoic dye within the leather, rinsed to remove unreacted diazonium salt, and finished in conventional fashion. After the drying of suede leathers dyed by either of these processes, they must be rebuffed to restore the suede surface, with a loss in surface depth of shade because of uneven penetration or formation of the dye in the leather fibers.

No satisfactory technique has been available for applying to leather large patterned areas of solid color or decorative patterns having fine detail. Techniques are particularly needed which are useful with napped suede leathers. Application of colored patterns to leather by block or letterpress printing without embossing the leather is virtually impossible, especially when the color is applied in large areas, in fine detail, or in separated portions of a large area. The stencil application of dye solutions is limited to the effects which can be obtained with such solutions. The silk screen application of pigmented pastes results in a stiffening of the surface which is particularly objectionable with buffed suede leathers. There is thus considerable need for a process which applies color to the surface of leather, and especially to napped suede leather, without significant change in the surface or bulk esthetic or physical properties of the leather. There are also needs for a process which applies one color to the surface and another color in depth throughout a piece of leather, and for a process which applies patterns to colored leather without expensive and complex equipment operated by highly skilled workmen.

It is an object of this invention to provide a simple and economical process for forming azoic dyes within the structure and fibers of leather without wetting the leather with water and without significant change in the surface and bulk esthetic or physical properties of the leather. It is another object of this invention to provide a process for the production of colored napped suede leather from dry napped leather without change in the surface properties of the leather such as would require rebuffing for restoration of the suede surface. It is a further object of this invention to provide a process for the production of dye patterns on the surface of leather, particularly while dyeing the bulk of the leather in the same or a different color in uniform strength and shade throughout and without significantly changing the surface esthetic or physical properties of the leather. These and other objects are achieved by the process of this invention as described hereinbelow.

SUMMARY OF THE INVENTION

In summary, this invention is an improved process for dyeing leather with azoic dyes comprising interacting, within leather, a diazonium component, and a coupling component to form a colored dye, wherein the improvement consists essentially of a. incorporating into substantially dry leather 1. a diazonium component, and
2. coupling component as required in solution in a substantially non-aqueous, volatile, low-viscosity liquid, and b. interreacting the diazonium component and a coupling component, without wetting the leather with water.

By this process, there is obtained colored leather having azoic dye formed therein from substantially dry leather without wetting with water and without significant change in the properties thereof.

DESCRIPTION OF PREFERRED EMBODIMENTS

A preferred embodiment of this invention is the above process wherein the liquid solvent for the diazonium component and the liquid solvent for any coupling component incorporated into substantially dry leather each have viscosities less than about 2 centipoise at 20°C. and vapor pressures greater than about 10 millimeters of mercury at 30°C., when incorporated into substantially dry leather, and contain less than about 25 percent water. In a more preferred embodiment of this invention, the liquids are at least partially evaporated from the leather at a temperature not over about 50°C. before effecting interaction of the diazonium component with the coupling component. In one particularly preferred embodiment, the liquids have viscosities less than about 1 centipoise at 20°C. and vapor pressures greater than about 25 millimeters of mercury at 30°C. and contain less than about 10 percent water and the liquids are at least partially evaporated from the leather before effecting interaction of the diazonium component with the coupling component. In another particularly preferred embodiment, the liquids consist essentially of at least one material chosen from among aliphatic alcohols containing 1 to 3 carbon atoms, aliphatic ketones containing 3 to 7 carbon atoms, such cyclic aliphatic ethers containing 4 carbon atoms as tetrahydrofuran, p-dioxane and m-dioxane, ethylene glycol monomethyl, dimethyl, and diethyl ethers, alkyl esters of alkanoic acids containing 3 to 6 carbon atoms, aliphatic and aromatic hydrocarbons containing 6 to 8 carbon atoms, and such chlorine containing aliphatic and aromatic hydrocarbons as chloroform, carbon tetrachloride, 1,1-dichloroethane, 1,2-dichloroethane, trichloroethylene, 1,1,2,2-tetrachloroethane, 1,1,2-trichloro-1,2,2-trifluoroethane, 1,2-dichloro-1,1,2,2-tetrafluoroethane, and chlorobenzene, and contain not more than about 10 percent water.

Another preferred embodiment of this invention is the above process in which a diazonium component and any coupling component are incorporated into dry leather in a volume of liquid sufficient to penetrate throughout the leather but not greater than the volume which the leather is able to absorb and contain without dripping. By such processes, leather is dyed in uniform strength and shade throughout, without removing from the leather desirable substances, such as fat liquors, which may be soluble in the liquids in which the components are dissolved.

A particularly simple and economical embodiment of this invention is the above process in which the leather into which the diazonium component is incorporated contains, as substantially the only coupling component, sufficient phenolic tanning agents and products of the reaction of phenolic tanning agents with leather to form a significant amount of colored dye and no additional coupling agent is incorporated into the leather. Substantially dry leather is dyed with particular economy and simplicity by such processes. In another particularly preferred embodiment, at least one other coupling component is incorporated into leather containing phenolic tanning agents and products of the reaction of phenolic tanning agents with leather. Leather is dyed economically in a variety of shades by such processes.

Another preferred embodiment of this invention is the above process in which a coupling component is incorporated into the leather before or after incorporation of the diazonium component, more preferably with the diazonium component and other components of the solution incorporated into the leather chosen so that the diazonium and coupling components interact after the diazonium component is incorporated into the leather because of process steps which effect their interaction. It is most convenient when the solution incorporated into leather contains both diazonium and coupling components. In a particularly preferred embodiment, the solution contains both diazonium and coupling components and sufficient acidic materials to prevent coupling of the diazonium and coupling components, and the process step effecting interaction of the diazonium and coupling components comprises incorporating into the leather, without wetting the leather with water, a nitrogenous base in sufficient amount to counteract the acidic materials. In a most preferred embodiment, the acidic material is an alkylbenzenesulfonic acid and the nitrogenous base is ammonia incorporated into the leather containing diazonium and coupling components by exposing the leather to moist ammonia vapors.

Another embodiment of this invention is the above process in which at least one diazonium component incorporated into dry leathr is light-sensitive and the surface of the leather is exposed to suitable light to decompose substantially all the light-sensitive diazonium component therein before effecting interaction of diazonium components with coupling components. In a preferred embodiment, only a portion of the surface of the leather is exposed to light to decompose the light-sensitive diazonium components therein. Dry leather is dyed in one color in at least a portion of the surface and anothr color elsewhere by such processes. The application of colored patterns to the surface of dry leather without significant change in the surface or bulk physical properties of the leather is simple and inexpensive by such processes.

In a highly preferred embodiment of this invention, a solution containing a light-sensitive diazonium component, a coupling component, and an amount of an acidic material sufficient to prevent interaction of the diazonium and coupling components in a liquid having a viscosity of less than about 1 centipoise at 20°C. and a vapor pressure greater than about 25 millimeters of mercury at 30°C. and containing less than about 10 percent water is incorporated into dry, buffed, suede leather, a portion of the liquid is evaporated at a temperature below about 50°C., a portion of the surface of the leather is exposed to ultraviolet light to decompose substantially all the light-sensitive diazonium component therein, and the leather is thereafter exposed to moist ammonia vapors for a sufficient time to affect coupling of the diazonium and coupling components.

DESCRIPTION OF THE INVENTION

The leathers which can be dyed by the process described herein include those tanned by such conventional processes as mineral tannage, vegetable tannage, and synthetic tannage and by combinations of these processes. Leathers tanned with colorless mineral materials, with vegetable materials, and with synthetic tanning materials are preferred because of their generally lighter colors. Leathers tanned at some stage with synthetic and vegetable tanning materials containing phenolic moieties are particularly preferred in processes in which diazonium salts interact to form colored dyes primarily with the tanning material or with products of the interaction of the tanning material with the leather. These leathers will preferably be unfinished in that they will not be surface-finished with fillers, lacquers, waxes, or other materials which will affect the penetration of the leather by low-viscosity non-aqueous liquids, but they can contain any of those materials which are normally present in leather which are non-reactive with diazonium salts and with the other materials involved in the process described herein, such as fat liquors, water-proofing materials, etc., in amounts which do not interfere with the dyeing process.

The process of this invention involves the incorporation of materials into substantially dry leather, by which is meant leather which can absorb significant amounts of water before water can be expelled therefrom by squeezing, pressing, or otherwise compacting. Such leather preferably contains water in amounts which are in equilibrium with ambient air having relative humidities as high as substantially 100 percent but cannot contain amounts of water sufficient to make it appear wet throughout or on the surface. For example, such leather can contain as much as 25 percent to 35 percent moisture removable by azeotropic distillation with a water-immiscible hydrocarbon like toluene.

The diazonium components which are useful in dyeing leather by this process include those diazonium components which are conventionally used in the production of azoic dyes and in processes in which azoic dyes are formed in textiles and paper, which can be obtained in useful concentrations in solutions in substantially non-aqueous, volatile, low-viscosity liquids. Such diazonium components are conventionally prepared from aromatic amines by diazotization in solution in water or other polar solvents as is known in the art.

Typical diazotizable aromatic amines include carbocyclic and heterocyclic aromatic amines which can be nuclearly unsubstituted or nuclearly substituted with one or more groups, including for example, the nitro, chlorine, bromine, alkyl, alkoxy, cyano, carboxy, keto, arylazo, acylamine, and sulfo groups. These substituent groups may be present in combination in the aromatic amine, which is preferably an aniline. Exemplifying diazotizable anilines are 4-nitroaniline
2-chloro-4-nitroaniline
4-aminoacetanilide
2-nitro-4-methylaniline
4-(o-tolylazo)-2-methylaniline
1-naphthylamine
2,5-dimethoxyaniline
4-cyanoaniline
3-chloroaniline
4-chloroaniline
2,5-dichloroaniline
o-toluidine
p-toluidine
4-chloro-6-(phenylsulfonyl)aniline
2-amino-5-chlorobenzenesulfonic acid
2,5-dichlorosulfanilic acid
aniline-2,5-disulfonic acid Exemplifying diazotizable heterocyclic amines are 2-aminobenzothiazole
2-amino-4-chlorobenzothiazole
2-amino-4-bromobenzothiazole
2-amino-4-nitrobenzothiazole
6-acetyl-2-aminobenzothiazole
6-amino-6-(trifluoroacetyl)benzothiazole
2-aminoimidazole Exemplifying diazotizable naphthalene derivatives are 1-amino-2-naphthalenesulfonic acid
5-amino-1-naphthalenesulfonic acid
5-amino-2-naphthalenesulfonic acid
8-amino-2-naphthalenesulfonic acid
5-acetamide-8-amino-2-naphthalenesulfonic acid
8-acetamide-5-amino-2-naphthalenesulfonic acid
2-amino-1-naphthalenesulfonic acid
6-amino-2-naphthalenesulfonic acid
8-amino-1,6-naphthalenedisulfonic acid
7-amino-1,3-naphthalenedisulfonic acid
6-amino-1,3-naphthalenedisulfonic acid The preferred diazonium components useful as described herein are diazonium salts derived from such aromatic amines.

Solutions of diazonium salts in substantially non-aqueous, volatile, low-viscosity liquids can be obtained in several ways. For example, some diazonium salts can be prepared in water solutions containing sufficiently high concentrations of diazonium salt for dilution with non-aqueous liquids to obtain useful substantially non-aqueous liquid solutions as defined herein. Alternately, some diazonium salts can be formed in substantially non-aqueous liquids by dissolving the aromatic amine in the liquid and introducing into the solution a diazotizing agent, such as nitrogen trioxide ($N_2O_3$); a mixed anhydride of nitrous acid and another acid, such as nitrosylsulfuric acid or nitrosyl chloride; an ester of nitrous acid, such as ethyl nitrite or tertiary-butyl nitrite; or a nitrous acid salt, such as sodium nitrite, and a suitably strong acid to convert the nitrite salt into nitrous acid.

The preferred technique for obtaining a solution of a diazonium component in a suitable liquid for use in the process of this invention is to dissolve in the liquid an isolated stable solid diazonium salt. Such stable diazonium salts can be, for example, complexes of diazonium salts with zinc chloride, salts with aromatic sulfonic acids, or salts with fluoboric acids as are known in the art. They include the stable diazonium salts described by Lubs in "The Chemistry of Synthetic Dyes and Pigments," Reinhold, New York (1955) at pages 209 to 215, including those described in the booklet "Du Pont 'Naphthanil' and 'Naphthanil' Diazo Colors on Cotton," distributed by Du Pont in 1953, such as 3-chlorophenyldiazonium fluoborate
2,5-dichlorophenyldiazonium zinc chloride
3-nitro-6-methoxyphenyldiazonium zinc chloride
anthraquinone-1-diazonium zinc chloride
4-(4'-methoxyphenyl)phenyldiazonium chloride
4-nitro-6-methoxyphenyldiazonium-1,5-naphthalene disulfonate and other similar stable diazonium salts. They also include the stable diazonium salts commonly used in azographic photoimaging processes as described by Kosar in "Light-Sensitive Systems," Wiley, New York (1965) at pages 194 to 214 and by Dinaburg in "Photosensitive Diazo Compounds," Focal Press, New York (1968), at pages 96 to 115, including p-diazodimethylaniline zinc chloride
p-diazodiethylaniline zinc chloride
p-diazo-N-methyl-N-hydroxyethylaniline zinc chloride
p-diazo-N-ethyl-N-hydroxyethylaniline zinc chloride
4-diazo-2,5-diethoxymorpholinobenzene zinc chloride
p-diazomorpholinobenzene zinc chloride
p-diazo-N-ethyl-o-toluidine zinc chloride
p-diazo-N-diethyl-m-toluidine zinc chloride
p-diazo-N-ethyl-N-hydroxyethyl-m-toluidine zinc chloride
p-diazo-N-diethyl-m-phenetidine zinc chloride and the corresponding salts of fluoboric acid, sometimes called borofluoride salts.

All such diazonium salts are useful in this process which are sufficiently soluble in substantially nonaqueous solvents as described herein, which are sufficiently temperature-stable and light-stable for application in solution to leather, and which interact with coupling components which can be incorporated into leather to form suitable and desirable colors. Particularly preferred diazonium salts for use in the photoimaging process described herein are 4-(N,N'-diethylamino)-phenyldiazonium fluoborate, 4-(N,N'-dibetahydroxyethylamino)-phenyldiazonium fluoborate, and 4-morpholinophenyldiazonium fluoborate because of the solubility of these salts in the solvents preferred for use in this process, the stability of these salts in combination with color-forming materials under practical conditions, the rates of photodecomposition of these salts, the rates of interaction of these salts with color-forming materials, and the colors formed by such interactions with phenolic tanning materials and the products of the interaction of phenolic tanning materials with leather. More photostable diazonium salts are normally preferred for the dyeing process described herein which do not involve photoimaging.

Diazonium coupling components which interact with diazonium components in the process of this invention include materials of various chemical classes, as is known in the art. For instance, they can be aromatic amine compounds having no diazotizable amino group and unsubstituted in the ortho or para position, compounds with activated methylene groups, or phenolic compounds having an unsubstituted position ortho or para to the phenolic group.

One class of aromatic amine compounds satisfactory for use as coupling components have a nuclearly-attached tertiary nitrogen atom and an unsubstituted nuclear position ortho to or preferably para to the tertiary nitrogen atom. Substituents on the tertiary nitrogen atom can be alkyl of 1 to 3 carbon atoms, such as methyl, ethyl, and propyl, preferably methyl or ethyl;
hydroxylalkyl, such as hydroxyethyl;
cyanoalkyl of 2 to 4 carbon atoms, such as cyanomethyl, beta-cyanoethyl or 2-cyanopropyl, preferably beta-cyanoethyl; and
acyloxyalkyl in which the acyl group is aliphatic acyl having 2 to 5 carbon atoms, such as acetyl, propionyl, and butyryl, preferably acetyl, or is arylacyl having 7 to 10 carbon atoms, such as benzoyl, toluoyl, or xyloyl, preferably benzoyl, and in which the alkyl moiety has 2 to 4 carbon atoms, such as ethyl or propyl, preferably ethyl.

Typical such tertiary amines include dimethylaniline
diethyl-m-toluidine
di-(n-propyl)-o-toluidine
N-cyanomethyl-N-(2'-acetoxyethyl)aniline
N,N-bis-(2'-cyanoethyl)aniline
N-methyl-N-(3'-cyanopropyl)-m-toluidine
N-cyanomethyl-N-(2'-acetoxyethyl)aniline
N,N-bis-(2'-acetoxyethyl)aniline
N,N-bis(3'-butyroxypropyl)-m-toluidine
N,N-bis-(2'-benzoyloxyethyl)-m-toluidine
N,N-bis-(2'-polyoxyethyl)-m-toluidine
N-(2-cyanoethyl)-N-(2'-benzoyloxymethyl)aniline
N-ethyl-N-(2'-cyanoethyl)aniline
N-ethyl-N-(2'-cyanoethyl)-m-toluidine
N-(2'-cyanoethyl)-N-(2'-hydroxyethyl)aniline
2-(N-ethylanilino)ethanol
phenyldiethanolamine
N,N-bis-(2'-hydroxyethyl)-m-toluidine
N-(2'-cyanoethyl)-N-(2'-mesitoyloxyethyl)aniline
N,N-bis-(2'-pivaloyloxyethyl)aniline
m-chlorodimethylaniline Aromatic amine coupling components which do not include a tertiary nitrogen atom include 7-amino-1-naphtholsulfonic acid
8-anilino-1-naphthalenesulfonic acid
8-p-toluidino-1-naphthalenesulfonic acid
6-anilino-1-naphtholsulfonic acid Compounds with activated methylene groups useful as coupling components include beta-diketones, such as benzoylacetone, 1,3-cyclohexanedione, and 1,3-perinaphthalineanedione;
beta-keto esters, such as ethyl acetoacetate, phenylacetoacetate, methyl-4,4,4-trifluoroacetoacetate, and methyl-p-nitrobenzoylacetate;
beta-ketoamides, such as acetoacet-4'-chloroanilide, acetoacetotoluidide, benzoylacet-3'-methoxyanilide, benzoylacet-alphabetanaphthylamide, and N,N'-ditolylmalonamide;
beta-ketonitriles, such as benzoylacetonitrile, 2'-thenoylacetonitrile, anisoylacetonitrile, 1-naphthoylacetonitrile, and p-nitrocannamoylacetonitrile; including heterocyclic betaketoamides, such as barbituric acid and N-substituted barbituric acids;
anilides of cyanoacetic acid, such as 2-cyanoacetanilide, 2-cyano-p-acetanisidide, and 2-cyano-4'-nitroacetanilide; and
beta-imineamides, such as 1-phenyl-3-methylpyrazol-5-one, 2-iminobarbituric acid and 1-(alpha-naphthyl)-3-methylpyrazol-5-one.

Coupling components useful in this process include particularly the diazo coupling components sold under the trade name "Naphthol" and "Naphthanil" and other similar materials well known in the textile dyeing art, such as are described in "The Chemistry of Synthetic Dyes and Pigments," at pages 182 to 193. A representative group of such coupling components is described in the booklet "Du Pont 'Naphthanil' and 'Naphthanil' Diazo Colors on Cotton," referred to above, such as 3-hydroxy-2-naphthanilide
3-hydroxy-2-naphth-o-toluidide
3-hydroxy-N-1-naphthyl-2-naphthamide and other similar coupling components. The useful coupling components also include the coupling components particularly used with light-sensitive diazonium salts in azographic imaging systems such as are described, for example, in "Light-Sensitive Systems," at pages 220 to 249. Preferred coupling components for use in photoimaging processes as described herein include 6,7-dihydroxy-2-naphthalene sodium sulfonate
2,3-dihydroxynaphthalene
beta-oxynaphthoic acid monoethanolamide
beta-oxynaphthoic acid aminoethyleneamide hydrochloride
beta-oxynaphthoic acid morpholinopropylamide
2,7-dihydroxy-3,6-naphthalene disodium sulfonate acetoacetanilide
beta-resorcylic acid monoethanolamide
ethylenediamine-N,N'-bisacetacetamide
resorcinol
monochlororesorcinol
diresorcinol
diresorcinol sulfide
m-hydroxyphenylurea
4-bromo-3,5-resorcylic acid
4-bromo-3,5-resorcylamide
phloroglucinol and other similar coupling components. More preferred coupling components of this type are acetoacetanilide and beta-oxynaphthoic acid morpholinopropylamide, which change color less upon prolonged exposure to ambient light and atmospheric conditions than do, for example, phenolic coupling components like resorcinol and phloroglucinol and most amino coupling components.

Preferred coupling components for interaction with diazonium salts to form colored dyes in the process described herein are phenolic natural vegetable and synthetic tanning agents and the products of their interaction with leather. Such materials contain unsubstituted positions ortho or para to phenolic groups and, therefore, interact with diazonium salts to form colored dyes under appropriate conditions. Tanning agents of vegetable origin can, for example, contain derivatives of gallic acid, digallic acid, and similar phenolic materials, as is known in the leather tanning art. Synthetic tanning agents can be sulfonated derivatives of products of the interaction of a phenol or a naphthol with formaldehyde and other materials.

The process of this invention involves incorporating materials into leather in solution in liquid which can be applied to the surface of the leather, penetrate into the leather, and evaporate from the leather without significant change in the surface or bulk esthetic and physical properties of the leather. Significant changes in leather properties are changes which significantly reduce the operability of the leather in its intended use. They include changes in the stiffness, hand, appearance, drape, wettability, and coatability of the leather which make it less desirable for the intended use. For example, they include changes produced by water, such as the matting of surface fibers in buffed suede leathers to such a degree that a rebuffing operation is required to restore suede leather properties and the stiffening of leathers to such a degree that a softening operation is required to restore the leather to a suppleness suitable for the intended use.

The liquids useful as solvents in this process are substantially non-aqueous, since the incorporation of substantially aqueous solvents into leather changes the surface and bulk esthetic and physical properties of the leather. Substantially non-aqueous liquid solvents can, however, contain water in such proportions that the solvents can be incorporated into leather without significant change in the properties of the leather. Such amounts of water are, in general, less than about 25 percent, based on the total weight of solvent. The maximum permissable amount of water in a liquid solvent useful as described herein may be limited by its effect on the solubility of the materials in the solution, by the amount of water present in the leather, by the type of leather, or by the effect of the water present in the liquid on the properties of the leather. It is preferred that the solvents of this process contain less than about 10 percent water. By the use of such liquids as solvents, diazonium components and other materials are incorporated into substantially dry leather without significant change in surface or bulk esthetic and physical properties.

The liquid solvents employed in this process are volatile in that they have sufficiently high vapor pressures to evaporate from the surface of leather at normal ambient temperatures, e.g. above about 15°C. The diazonium components involved in the process have different but usually low stabilities at elevated temperatures, decomposing upon heating and losing their ability to form colored dyes. Suitable liquids have vapor pressures greater than about 10 millimeters of mercury at 30°C. and the preferred liquids have vapor pressures greater than about 25 millimeters of mercury at 30°C. and, therefore, evaporate especially quickly from leather surfaces upon exposure to air at temperatures below about 50°C. Many suitable liquids are well known as solvents for organic materials, particularly for use in paints, lacquers, and varnishes.

Liquid solvents useful in this process are low in viscosity, having sufficiently low viscosities to spread upon and penetrate rapidly into substantially dry leather. For example, they have viscosities below about 2 centipoise at 20°C. and preferably have viscosities below about 1 centipoise at 20°C.

Liquids suitable for use as solvents in this process can be of several different chemical types so long as they do not adversely interact with the other materials involved in the process, have no significant adverse effect on the properties of leather, and are otherwise suitable for use in leather processing. For example, they include aliphatic alcohols containing 1 to 3 carbon atoms,
aliphatic ketones containing 3 to 7 carbon atoms,
cyclic aliphatic ethers containing 4 carbon atoms, such as tetrahydrofuran, p-dioxane, m-dioxane,
ethylene glycol monomethyl, dimethyl, and diethyl ethers, aliphatic esters of alkanoic acids, which esters contain 3 to 6 carbon atoms, such as methyl, ethyl, and propyl acetate and propionate, ethyl butyrate, and diethyl carbonate, chlorine-containing hydrocarbons, such as chloroform, carbon tetrachloride, 1,1-dichloroethane, 1,2-dichloroethane, trichloroethylene, 1,1,2,2-tetrachloroethane, 1,1,2-trichloro-1,2,2-trifluoroethane, 1,2-dichloro-1,1,2,2-tetrafluoroethane, and chlorobenzene and mixtures thereof. The preferred liquids are aliphatic alcohols containing 1 to 3 carbon atoms and aliphatic ketones containing 3 to 7 carbon atoms, and particularly ethanol, isopropanol, acetone, methyl ethyl ketone, and methylisobutyl ketone which are substantially non-aqueous but may contain small amounts of water as indicated hereinabove.

The solutions of diazonium components incorporated into leather as described herein can contain diazonium components in any concentration which is soluble in the solution liquid and which is sufficient to produce significant color when incorporated in practical volumes into leather containing coupling components. Typically these solutions contain between about 1 and 10 weight percent diazonium components and preferably they contain between about 2 and 5 percent by weight diazonium components. The use of amounts of diazonium components greatly in excess of the stoichiometric equivalent of the amounts of coupling components present in the leather should be avoided to reduce the effect of the dyeing process on the properties of the leather.

Solutions of diazonium components incorporated into leather in the process of this invention can contain other components in addition to the diazonium component and water in amounts discussed hereinabove. These materials can be desirable adjuncts of the diazonium component or the dyeing process or can be materials which have desirable effects on the leather being dyed. For example, these solutions can contain stabilizers for the diazonium components such as urea, thiourea, 1,3,6-naphthalenetrisulfonic acid or its salts, and other such materials as described in "Light-Sensitive Systems," at page 292, and "Photosensitive Diazo Compounds," at page 92, and elsewhere as is known in the art. Such stabilizing materials are typically used in substantially stoichiometric amounts with respect to the diazonium component being stabilized. These solutions can also optionally contain fluorochemicals, silicones and other such materials which as are soluble therein and reduce the tendency of the leather to water-spot as well as oils, fat liquors, and other such materials which make the leather more supple or otherwise improve its physical properties. Other materials which can be included in solutions of diazonium components are discussed hereinbelow.

Solutions of diazonium components can be incorporated into leather by any convenient procedure which introduces the desired amount of the solution into the leather. For example, such solutions can be applied by brushing or spraying the solution onto the leather or by dipping the leather into the solution. The amount of solution incorporated into the leather can be controlled by the amount applied; by the conditions of application, such as the pressure and equipment used in spraying and the area rate of application in brushing; and by adjustment of the properties of the solution and of the leather surface which influence the rate and amount of solution absorbed. The preferred method of application is by spraying, using conditions which result in the degree of penetration which is desired. Thus, minimum amounts of solution should be applied with low spraying pressures when dyeing is desired primarily on the surface of the leather and larger amounts should be applied with higher spraying pressures when dyeing is desired throughout the leather. The minimum amount of solution applied should be sufficient to incorporate into the leather enough diazonium component to form significant color in the portions of the leather desired to be dyed. Preferably the amount of solution applied is not greater than the amount which the leather is able to absorb and contain without dripping and preferably is such an amount that no liquid is expelled from the leather upon pressing or squeezing, so as to avoid removing from the leather desirable materials such as fat liquors which are soluble in the solution. Typical amounts incorporated when dyeing is desired throughout are between about 30 and 80 percent of the nominal volume of the leather.

Interaction of diazonium components and coupling components within leather can be effected in any of several ways. In a very simple process of this invention, the diazonium components interact with coupling components immediately upon incorporation of the diazonium component solution into leather. The preferred conditions for interaction of different diazonium and coupling components are slightly different, but in general such components interact rapidly when they are in a medium containing sufficient of a polar solvent for ionic interactions, e.g. more than about 10 percent moisture by weight, and having a pH greater than about 5. Immediate interaction of diazonium and coupling components within leather is therefore effected whenever the leather after incorporation of the diazonium component solution has a pH at which interaction is relatively fast and contains sufficient moisture. Since substantially dry leather normally contains sufficient moisture, such conditions prevail when either the diazonium component solution or the leather contains an excess of alkaline materials over the acidic materials present in the other. Processes of this very simple type are preferred when it is desired to dye leather primarily in and near the surface rather than throughout, since the leather is dyed first and most intensely near the surface as the diazonium component solution penetrates through the surface.

Uniform dyeing of leather throughout is more effectively obtained in processes in which the diazonium component solution penetrates throughout the leather without interaction between diazonium and coupling components and conditions are thereafter changed to promote interaction of the diazonium and coupling components. Such interaction can be substantially prevented by maintaining a solution of leather containing components of both types in sufficiently acidic condition, ordinarily at a pH less than about 5 dependent on the diazonium and coupling components as is known in the art. In such processes a diazonium solution containing a sufficient amount of a suitable acidic material can be incorporated into an acidic leather or into a leather containing insufficient alkaline materials to neutralize the acidic materials in the diazonium component solution. Acidic materials which prevent or retard interaction between diazonium and coupling components include the inorganic acids but are preferably organic acids, such as tartaric acid, citric acid, naphthalenesulfonic acid, or benzenesulfonic acid, as described in "Light-Sensitive Systems," at pages 249 to 259. A preferred acidic material for use in diazonium component solutions containing photosensitive diazonium components is an alkylbenzenesulfonic acid, such as the dodecylbenzenesulfonic acid obtainable from the Richardson Company, Melrose Park, Illinois, as "Richonic Acid B." Such acidic materials are usually employed in diazonium component solutions in at least about stoichiometric amounts with respect to the diazonium components and are preferably employed in amounts such that leather has a pH less than about 5 after incorporation of the diazonium component solution therein.

Changing conditions to effect interaction of diazonium and coupling components present together in leather without interaction can be effected in several ways to form azoic dyes within the fibers of the leather without significantly changing the properties of the leather. For example, with leather containing diazonium components which are sufficiently stable toward heat; acidic materials, such as tartaric acid, which prevent the interaction of the components; and materials which decompose upon heating to liberate alkaline materials, such as ammonium chloride, biuret, and urea; interaction of the diazonium and coupling components can be effected by heating the leather to temperatures and for times which induce the formation of sufficient alkaline materials to counteract the stabilizing action of the acidic materials. Preferably interaction of diazonium and coupling components in leathers containing acidic materials is effected by introducing into the leather sufficient alkaline materials to neutralize the acidic materials. For instance, an alkaline material can be incorporated into the leather in sufficient amount in solution in a substantially non-aqueous, volatile, low-viscosity liquid as defined hereinabove. The alkaline material can be any inorganic or organic material sufficiently alkaline and soluble in such a liquid to a sufficient degree but is preferably a nitrogenous base, such as ammonia or a primary, secondary, or tertiary amine containing up to about 30 carbon atoms. In a more preferred process, the alkaline material is ammonia incorporated into the leather by exposure of the leather to moist ammonia vapors, such as are obtained by evaporation of aqueous ammonium hydroxide. Typically the leather is exposed to the enclosed vapors of dilute aqueous ammonia at ambient temperatures for times between about 1 and 10 minutes.

Whenever a diazonium component solution is incorporated as described herein into leather not already containing sufficient coupling components to form significant amounts of color or optionally whenever the coupling components present in the leather form color of hue or strength other than desired, the process of this invention includes incorporation of one or more additional coupling components into the leather without significantly changing the surface or bulk esthetic or physical properties of the leather. Such coupling components are preferably incorporated into the leather in the same solution as the diazonium component but can be incorporated in a different solution either before or subsequent to incorporation of the diazonium component. When in the same solution as the diazonium component, the solution must be stabilized to prevent interaction between the diazonium and coupling components, for example, by inclusion in the solution of acidic materials as described above. When incorporated in a different solution, the coupling component can be in a substantially non-aqueous, volatile, low-viscosity liquid as defined hereinabove, which liquid can be but is not necessarily the same as the liquid in which the diazonium component is incorporated. When the two components are in different solutions, the total amount of solution present in and on the leather at any one time is preferably less than the leather is able to absorb and contain without dripping and preferably is an amount such that no liquid is expelled from the leather upon pressing or squeezing. Solutions of coupling components incorporated into leather as described can contain any amount of coupling agent below the amount which saturates the solution and which is sufficient when incorporated into the leather in a practical volume of solution to form significant color. Such solutions will normally contain between about 1 and 10 weight percent coupling component and preferably contain between about 2 and 5 weight percent.

The quantities of diazonium and coupling components incorporated into leather are preferably such that only insignificant amounts of either component remain in the leather after interaction is effected between such components. For example, leather dyed in colors only slightly shaded from those derived from natural and synthetic tanning agents and reaction products of such agents with leather can be obtained by incorporating small amounts of appropriate coupling components into the leather without increasing the amount of diazonium component incorporated into the leather above that stoichiometrically equivalent to the phenolic agents in the leather. When it is desired, however, to dye leather containing phenolic tanning agents in colors distinctly different from those formed by interaction of diazonium components with these tanning agents, coupling agents in amounts up to about three times the stoichiometric equivalent to the diazonium component can be incorporated into the leather in amounts independent of but preferably in excess of the stoichiometric equivalent of tanning agents. Particularly when the coupling component is chosen for more rapid interaction than the tanning agent with the diazonium component, the formation of colored dye by the tanning agent will be reduced. In such processes, the total amount of material incorporated into the leather must be small enough to have an insignificant effect on the properties of the leather.

In one aspect of the invention process, the diazonium component incorporated into leather is light-sensitive and the surface of the leather is exposed to suitable light to photo-decompose substantially all the diazonium component therein before effecting interaction of diazonium components with coupling components. By such a process, leather can be dyed in one color throughout and another color in the surface. If the desired surface color is not that of the undyed leather, a photostable diazonium component can be incorporated into the leather along with a light-sensitive diazonium component to obtain leather dyed in the surface with a color derived from the photostable diazonium component and dyed elsewhere with a color derived from both the photostable and light-sensitive diazonium components. In a preferred aspect of the invention, only a portion of the surface of the leather containing a photosensitive diazonium component is exposed to light to decompose the diazonium component and a colored pattern is thereby simply and inexpensively applied to the surface of the leather without significant change in surface or bulk physical properties.

The photoimaging techniques used in dyeing and patterning leather as described herein can be those which are well known in the paper and film azographic imaging art, such as are appropriate with the particular photosensitive diazonium components employed, their sensitivity to light of various wavelengths, their stability toward heat, their reactivity with the coupling components employed, and their efficiency of stabilization against interaction with coupling components. For example, exposure times can be between a few seconds and a few minutes at distances up to a few feet depending upon the intensity of the light source in the region between about 3600 and 4500 Angstroms. Suitable high intensity light sources include carbon arcs, mercury vapor arcs, fluorescent lamps with ultraviolet-emitting phosphors, argon glow lamps, and electronic flash units containing photoemitting gases such as xenon. It is particularly desirable when photoimaging leathers with rough or buffed surfaces to use light from a diffuse source or to expose the surface of the leather to light from a series of different angles so as to assure substantially complete decomposition of the diazonium component in those portions of the leather surface which would otherwise be in the shadows of fibers and other irregularities in the surface of the leather. The photoimaging can be through masks, stencils, or plastic films, etc., which can be positives or negatives depending upon the effects desired. Such imaging media are preferably placed near the leather when sharp detail is desired in the photoimaged patterns.

In a preferred aspect of the dyeing process of this invention at least a portion of any liquid employed as a solvent in incorporating a diazonium component or other material into leather is evaporated from the leather at a temperature not over about 50°C. before incorporating another solution into the leather or effecting interaction of the diazonium component with a coupling component. Such evaporation will normally occur upon exposure of the leather into which a solution is incorporated to the atmosphere during normal handling of the leather. In general, it is desirable to evaporate at least enough of the liquid to leave the surface of the leather free of liquid, particularly before exposing such surface to light to decompose the diazonium component therein. The liquid does not influence the rate or extent of decomposition of the diazonium component, but it is desirable to have the diazonium component entirely inside the structure of the leather and not in a solution upon the surface of the leather fibers or other structural units. Complete evaporation of the liquid from the interior of the leather is not required or advantageous, but will normally occur during later processing of the leather. Exposure of the leather to temperatures above about 50°C. is desirably avoided because of the thermal instability of diazonium components. Preferably any such drying is obtained by passing air at ambient temperatures, e.g., temperatures above about 15°C., over the surface of the leather.

The following examples illustrate the invention. Parts and percentages referred to therein are by weight, unless otherwise indicated.

EXAMPLE 1

About 20 milliliters of an acetone solution containing about 0.5 gram of 4-morpholinophenyldiazonium fluoborate and made acidic with about one milliliter of dodecylbenzenesulfonic acid was applied by brushing to one surface of about 75 square centimeters of a dry vegetable tanned beige-colored soft buffed suede clothing leather. The solution spread evenly over the surface of the leather and penetrated throughout. After the rapid evaporation of most of the acetone, one surface of the leather was exposed through a negative plastic transparency for about 2 mimutes at a distance of about 2 inches to an ultraviolet light source in a "contact printer" of a type suitable for use with azographic reproduction processes. The leather was then exposed for about 4 minutes to the vapors of aqueous ammonia. The surface portions not exposed to ultraviolet light were dyed a dark brown shade while those surface portions exposed to ultraviolet light remained a substantially unchanged beige color. The leather was dyed dark brown throughout, as shown by the even coloration of a cross-section. The surface and bulk esthetic and physical properties of the leather were not significantly affected by the dyeing process.

EXAMPLE 2

To about 75 square centimeters of another portion of the leather used in Example 1 was applied by brushing about 0.5 milliliter per square centimeter of an acetone solution containing about 0.2 gram per milliliter of 4-morpholinophenyl diazonium fluoborate, about 0.02 gram per milliliter of dodecylbenzenesulfonic acid, and about 0.1 gram per milliliter of N-(N'-morpholino-gamma-propyl)-2-hydroxy-3-naphthamide as a coupling agent. A major portion of the acetone evaporated from the leather during about 10 minutes exposure to the laboratory atmosphere. One surface of the leather was exposed through a negative plastic transparency for about 3 minutes to ultraviolet light in a "contact printer" and the leather was then exposed for about 5 minutes to moist ammonia vapors. The portion of the leather surface exposed to ultraviolet light reamined a beige color. The surface portions not exposed to ultraviolet light were dyed a purple brown shade and the leather was dyed the same purple brown color throughout by interaction of the diazonium salt with the coupling agent and with the vegetable tanning agent and/or with products of the interaction of the tanning agent with the leather. The surface and bulk esthetic and physical properties of the leather were not significantly affected by the dyeing process.

EXAMPLE 3

Procedures substantially like those of Examples 1 and 2 were followed in which a solution containing p-diethylaminophenyl diazonium borofluoride, a small stoichiometric excess of resorcinol as a coupling agent, and sufficient citric acid monohydrate to prevent interaction of the diazonium salt and the coupling agent were dissolved in methylethylketone and the solution was sprayed at moderate pressure onto the surface of the buffed suede leather, the major portion of the solvent was quickly evaporated, the surface of the leather was imaged through a negative with ultraviolet light for about 2 minutes in a "contact printer," and the leather was then exposed to moist ammonia fumes. The portions of the surface exposed to ultraviolet light remained substantially the original color of the leather. The portions of the surface not exposed to ultraviolet light were dyed a brown shade and the leather was dyed the same brown shade throughout. The surface and bulk esthetic and physical properties of the leather were substantially unaffected by the dyeing process.

EXAMPLE 4

Procedures substantially like those of Examples 1 to 3 were followed in which a solution containing p-diethylaminophenyl diazonium borofluoride, phloroglucinol as a coupling agent, and sufficient dodecylbenzenesulfonic acid to prevent interaction of the diazonium salt and the coupling agent were dissolved in acetone and the solution was sprayed at low pressure onto one surface of a dry chrome tanned "brushed casual" shoe cowhide leather. The solution spread evenly over the sprayed surface of the leather but did not penetrate throughout. The major portion of the acetone was evaporated quickly by exposing the leather to the laboratory atmosphere for a few minutes and the leather was then exposed for several minutes to moist ammonia vapors. The sprayed surface of the leather and those portions into which the sprayed solution penetrated became dyed an olive green color but the leather remained substantially unchanged in color on the unsprayed surface and in those portions into which the solution did not penetrate. The surface and bulk esthetic and physical properties of the leather were not significantly affected by the dyeing process.

I claim:

1. An improved process for dyeing leather with azoic dyes without significantly changing the surface or bulk esthetic or physical properties of the leather which comprises interacting within leather a diazonium and a coupling component to form a colored dye wherein the improvement consists essentially of (a) incorporating into substantially dry leather simultaneously or sequentially (1) a diazonium component, and (2) coupling component as required, in solution in a substantially non-aqueous, volatile, low-viscosity solvent liquid containing less than about 25% water, (b) interacting the diazonium component and a coupling component without wetting the leather with water, and (c) evaporating any remaining solvent liquid from the leather at ambient temperatures.

2. The process of claim 1 wherein the solvent liquid has a viscosity of less than about 2 centipoise at 20°C., and a vapor pressure of at least 10 millimeters of mercury at 30°C.

3. The process of claim 2 wherein the solvent liquid has a viscosity of less than about 1 centipoise at 20°C., a vapor pressure of at least 25 millimeters of mercury at 30°C. and contains less than about 10 percent water.

4. A process of claim 1 wherein the solvent liquid is at least partially evaporated from the leather at a temperature of no more than 50°C. before interreaction of the diazonium component and coupling component.

5. A process of claim 1 wherein the volume of solvent liquid used is sufficient to penetrate the leather but nor more than sufficient to saturate the leather.

6. A process of claim 1 wherein the coupling component is a phenolic tanning agent or a reaction product of leather and a phenolic tanning agent.

7. A process of claim 1 wherein a coupling component is incorporated into the leather before a diazonium component.

8. A process of claim 1 wherein a coupling component is incorporated into the leather after a diazonium component.

9. A process of claim 1 wherein a coupling component is incorporated into the leather in the same solvent liquid with a diazonium component.

10. A process of claim 1 wherein a diazonium conponent incorporated into the leather is light sensitive and is photoactivated before interreaction of the diazonium component and a coupling component.

11. A process of claim 3 wherein the solvent liquid contains an aliphatic alcohol of 1 to 3 carbon atoms, an aliphatic ketone of 3 to 7 carbon atoms, a cyclic aliphatic ether of 4 carbon atoms, ethylene glycol monomethyl, dimethyl or diethyl ether, an aliphatic ester of an alkanoic acid, which ester contains 3 to 6 carbon atoms, or chloroform, carbon tetrachloride, 1,1-dichloroethane, 1,2-dichloroethane, trichloroethylene, 1,1,2,2-tetrachloroethane, 1,1,2-trichloro-1,2,2-trifluoroethane, 1,2-dichloro-1,1,2,2-tetrafluoroethane, or chlorobenzene.

12. A process of claim 1 wherein at least one coupling component is incorporated into the leather which is not a phenolic tanning agent nor a reaction product of leather and a phenolic tanning agent.

13. A process of claim 9 wherein the solvent liquid contains in addition to a coupling component and a diazonium component a sufficient amount of an acidic component to prevent a coupling reaction.

14. A process of claim 10 wherein the light sensitive diazonium component is photoactivated in a pattern.

15. A process of claim 13 wherein the coupling reaction is initiated by neutralizing the acidic component with a base.

16. A process of claim 13 wherein the leather is dry buffed suede;

the solvent liquid has a viscosity of less than about 1 centipoise at 20°C., a vapor pressure greater than about 25 millimeters of mercury at 30°C. and contains less than about 10 percent water;

a diazonium component is used which is light sensitive;

a portion of the liquid is evaporated at a temperature below about 50°C. prior to the coupling reaction;

a portion of the leather surface is exposed to ultraviolet light after solvent evaporation and before the coupling reaction to photoactivate some of the diazonium component; and the leather is exposed to moist ammonia vapors for a time sufficient to effect the coupling reaction.

17. A process of claim 15 wherein the acidic component is an alkylbenzenesulfonic acid and the base is ammonia.

* * * * *